US005939836A

United States Patent [19]

Mita et al.

[11] Patent Number: 5,939,836

[45] Date of Patent: Aug. 17, 1999

[54] DISCHARGE LAMP LIGHTING APPARATUS AND LIGHTING APPARATUS

[75] Inventors: Kazutoshi Mita; Keiichi Shimizu, both of Kanagawa-ken; Kazuyuki Uratani, Tokyo; Fuminori Nakaya, Kanagawa-ken, all of Japan

[73] Assignee: Toshiba Lighting & Technology Corp., Tokyo, Japan

[21] Appl. No.: 08/982,264

[22] Filed: Dec. 1, 1997

[30] Foreign Application Priority Data

Nov. 29, 1996 [JP] Japan ..... 8-320309

[51] Int. Cl.[6] ..... G05F 1/00

[52] U.S. Cl. ..... 315/224; 315/94; 315/105; 315/307; 315/DIG. 4

[58] Field of Search ..... 315/224, 307, 315/DIG. 5, 105, 209 T, 94, 291, 209 R, 244, 225, DIG. 4, 297

[56] References Cited

U.S. PATENT DOCUMENTS

| | | | |
|---|---|---|---|
| 4,334,725 | 6/1982 | Teshima et al. | 316/19 |
| 4,575,344 | 3/1986 | Bouchard et al. | 445/26 |
| 4,585,974 | 4/1986 | Stupp et al. | 315/307 |
| 4,803,401 | 2/1989 | Matsuno et al. | 313/489 |
| 4,840,593 | 6/1989 | Takeda et al. | 445/26 |
| 5,198,726 | 3/1993 | Van Meurs et al. | 315/224 |
| 5,382,881 | 1/1995 | Farkas et al. | 315/224 |
| 5,424,611 | 6/1995 | Moriarty, Jr. | 315/94 |
| 5,619,090 | 4/1997 | Vervecken | 313/25 |
| 5,629,588 | 5/1997 | Oda et al. | 315/307 |
| 5,670,849 | 9/1997 | Melai | 315/224 |
| 5,734,232 | 3/1998 | Hendrix et al. | 315/224 |

FOREIGN PATENT DOCUMENTS

| | | |
|---|---|---|
| 0 338 109 A1 | 10/1989 | European Pat. Off. . |
| 0 471 332 A1 | 2/1992 | European Pat. Off. . |
| 0 594 880 A1 | 5/1994 | European Pat. Off. . |
| 4100349 A1 | 8/1991 | Germany . |
| 4303595 A1 | 8/1994 | Germany . |
| 4303624 A1 | 8/1994 | Germany . |

*Primary Examiner*—Don Wong
*Assistant Examiner*—Wilson Lee
*Attorney, Agent, or Firm*—Pillsbury Madison & Sutro LLP

[57] ABSTRACT

A discharge lamp lighting apparatus of the present invention includes an inverter to convert input DC voltage into high frequency voltage and supply the converted high frequency voltage to a discharge lamp having filaments, a preheating circuit to preheat the filaments of the discharge lamp, filament voltage detecting circuits to detect voltage applied between both ends of the filaments of the discharge lamp, and an output control circuit to control the inverter to stop or lower the output of high frequency voltage when the detected result of the filament voltage detecting circuit exceeds a specified value.

27 Claims, 10 Drawing Sheets

DISCHARGE LAMP LIGHTING APPARATUS AND LIGHTING APPARATUS

BACKGROUND OF THE INVENTION

1. Field of the Invention

The present invention relates to a discharge lamp lighting apparatus to light a discharge lamp and a lighting apparatus using this discharge lamp lighting apparatus.

2. Description of the Related Art

Fluorescent lamps, metal halide lamps, mercury lamps and high pressure sodium lamps, etc. have been merchandised so far for use as discharge lamps. As conventional discharge lamp lighting apparatus to operate these discharge lamps, there are such apparatus developed that a high frequency oscillation circuit generates high frequency voltage by turning DC voltage from a rectifying means ON/OFF using a switching device in the ON time adjustable state and supplies this high frequency voltage to discharge lamps.

Further, discharge lamps in a small tube diameter of about 15 mm which was so far 30 mm are developed recently. On the other hand, if the tube diameter of a discharge lamp is small, its starting voltage will tend to become high. Therefore, when a discharge lamp in a small tube diameter is an applicable load, it is necessary to set the output voltage of an inverter at a high level.

There are some discharge lamp lighting apparatus which have capacitors connected in parallel to the discharge lamps for preheating filaments. In case of a discharge lamp lighting apparatus with capacitors connected in parallel, preheating current becomes almost constant-current if a resistance of filament is small and this constant-current is proportional to the output voltage of the inverter.

On the other hand, a metallic vapor deposited film (mainly composed of tungsten with electric resistance of several hundred Q) is produced between stems of a discharge lamp by spatter of filament and when the filament is burnt out, constant-current supplied from the capacitor flows to the metallic vapor deposited film and consumes electric power. Therefore, if the tube diameter is too small, flares and stems of a thin discharge lamp are dissolved and the dissolved flares and stems contact the tube wall and may crack the tube. Further, when resin member is used for component parts of the discharge lamp, for example, electrode sockets, there is the danger that this electrode sockets are dissolved or ignited. It was therefore difficult to make the tube diameter of discharge lamps too small.

On a conventional discharge lamp lighting apparatus with capacitors connected in parallel to the discharge lamps for preheating filaments described above, constant-current supplied from the capacitors flows to a metallic vapor deposited film formed by the spatter consumes electric power when a filament is burned out. Because of this, if a tube diameter is made too small, flares and stems of discharge lamps are dissolved and the lamp crack is caused when dissolved flares and stems contact the tube wall. Further, when resin members are used for component parts, they can be dissolved or ignited. It was therefore difficult to make the tube diameter of discharge lamps too small.

SUMMARY OF THE INVENTION

It is an object of the present invention to provide a discharge lamp lighting apparatus in a simple circuit construction, which is capable of reducing electric power generated on a metallic vapor deposited film by the spatter when a filament is burnt out.

According to the present invention, a discharge lamp lighting apparatus is provided, which comprising an inverter for converting input DC voltage into high frequency and supplying converted high frequency voltage to a discharge lamp having filaments; preheating means for preheating the filaments of the discharge lamp; filament voltage detecting circuits for detecting voltage applied between both ends of the filaments of the discharge lamp; and an output control circuit for controlling the inverter to stop or lower the output of high frequency voltage when detected results of the filament voltage detecting circuits exceed a specified value.

BRIEF DESCRIPTION OF THE DRAWINGS

The present invention will be described in more detail by way of example shown by drawings in which.

DETAILED DESCRIPTION OF THE PREFERRED EMBODIMENTS

Hereinafter, preferred embodiments of the present invention will be described with reference to the attached drawings.

Figure 1:
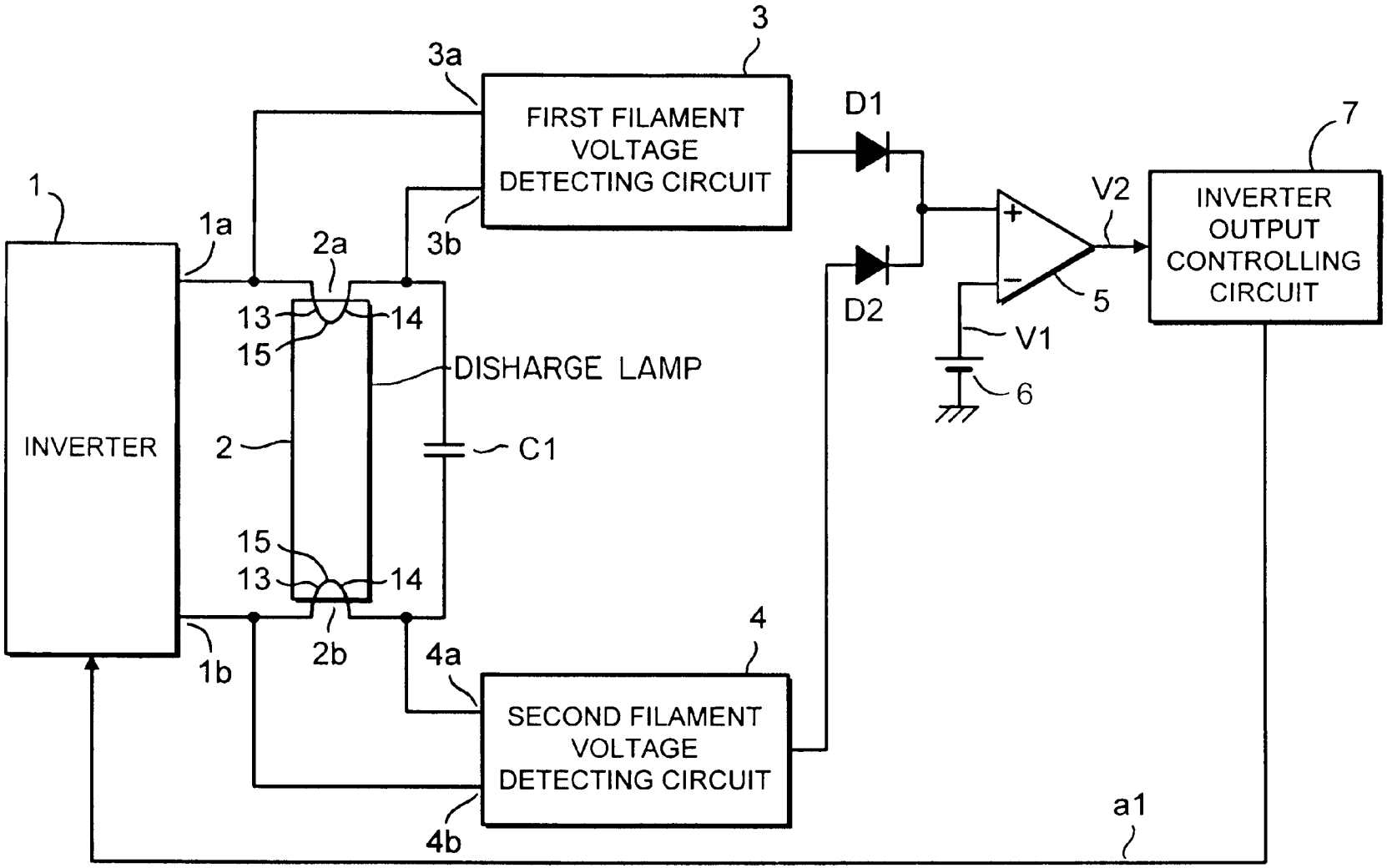
FIG. 1 is a block diagram showing a first embodiment of a discharge lamp lighting apparatus of the present invention.

FIG. 1 is a block diagram showing a first embodiment of the discharge lamp lighting apparatus of the present invention.

In FIG. 1, a reference numeral 1 denotes an inverter which converts input DC voltage to high frequency voltage and supplies it to a discharge lamp.

An output terminal la of the inverter 1 is connected to one end of a filament 15 of an electrode 2*a* by way of a first stem 13 of the electrode 2*a* of a discharge lamp 2. The other output terminal 1*b* of the inverter 1 is connected to one end of the filament 15 of the other electrode 2*b* of the discharge lamp 2 via the first stem 13 of the other electrode 2*b*.

A capacitor C1 is for preheating when starting the discharge lamp and is connected to the discharge lamp 2 in parallel. When described in more detail, one of the terminals of the capacitor C1 is connected to the other end of the filament 15 of the electrodes 2*a* via a second stem 14 of the electrode 2*a* of the discharge lamp 2. The other end of the capacitor C1 is connected to the other end of the filament of the electrode 2*b* via the second stem 14 of the electrode 2*b* of the discharge lamp 2.

A first and a second input terminals 3*a* and 3*b* of a first filament voltage detecting circuit 3 are connected to the first and second stems 13 and 14 of the electrodes 2*a* of the discharge lamp 2, respectively. The first filament voltage detecting circuit 3 detects voltage applied between the first and second stems 13 and 14 of the electrodes 2*a* of the discharge lamp 2 and supplies the detected voltage to a non-inversion input terminal (+) of a comparator 5 via the anode-cathode path of a diode D1.

First and second input terminals 4*a* and 4*b* of a second filament voltage detecting circuit 4 are connected to the first and second stems 13 and 14 of the electrodes 2*b* of the discharge lamp 2, respectively. The second filament voltage detecting circuit 4 detects voltage applied between the first and second stems 13 and 14 of the electrodes 2*b* of the discharge lamp 2 and supplies the detected voltage to the non-inversion input terminal (+) of the comparator 5 via the anode-cathode path of a diode D2.

DC voltage V1 from a DC regulated voltage source 6 is led to an inversion input terminal (−) of the comparator 5.

When at least one of detected results of the first and second filament voltage detecting circuits 3 and 4 exceeds the DC voltage V1, the comparator 5 supplies high level (H) output voltage V2 to an inverter output controlling circuit 7 and when it is below the DC voltage V1, supplies low level (L) output voltage V2 to the inverter output controlling circuit 7.

When the output voltage V2 of the comparator 5 is at high level (H), the inverter output controlling circuit 7 supplies a control signal a1 to the inverter 1 to stop or lower the output of the inverter 1. When the output voltage V2 of the comparator 5 is at low level (L), the inverter output controlling circuit 7 supplies a control signal a1 to the inverter 1 to carry out the normal operation.

Thus, the diodes D1 and D2, the comparator 5 and the DC regulated voltage source 6, and the inverter output controlling circuit 7 comprise an output control circuit to stop or lower the output of high frequency voltage by controlling the inverter 1 if the detected results of the first and second filament voltage detecting circuits 3 and 4 are in excess of a specified value.

Figure 2:
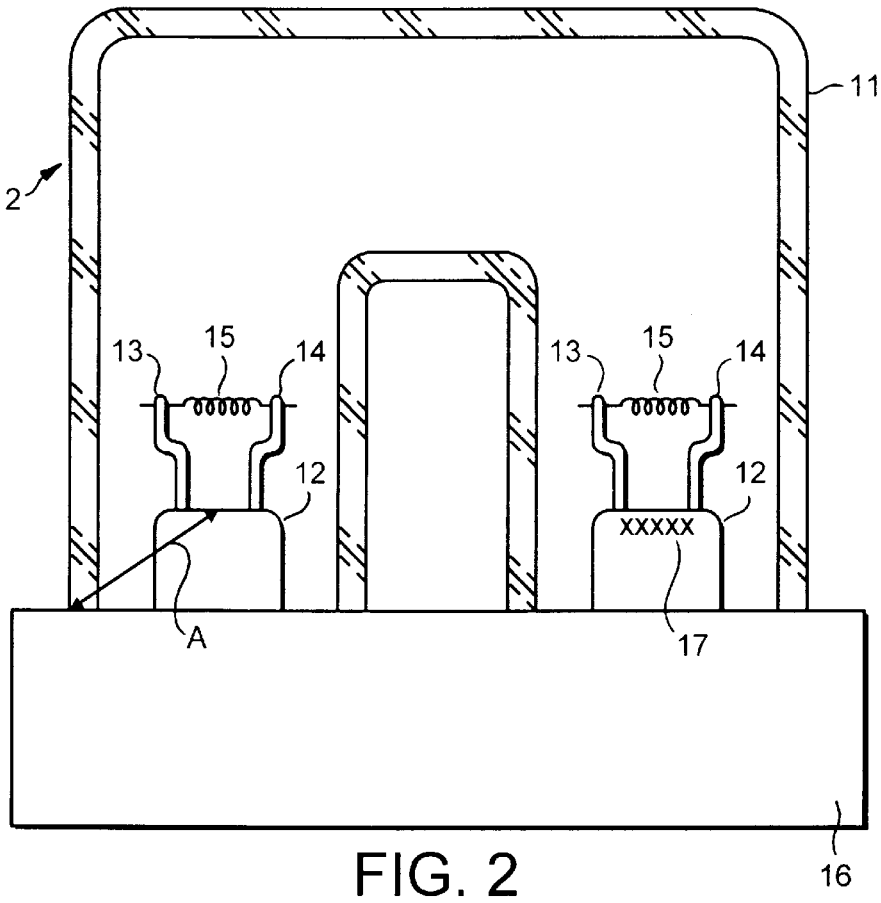
FIG. 2 is a sectional view showing the state of a discharge lamp which was so far used to a certain extent.

FIG. 2 is a sectional view showing the state of the discharge lamp 2 shown in FIG. 1 which so far was used to a certain extent.

In FIG. 2, Reference Numeral 11 is an arc tube made of a U-shaped glass tube and each of both ends of this arc tube 11 is tightly closed by a flare 12. On the flare 12, the first and second stems 13 and 14 are erected at specified spaces. The filament 15 is provided between the first and second stems 13 and 14. At both ends of the arc tube 11, an electrode socket 16 is mounted. The discharge lamp 2 is connected to the discharge lamp lighting apparatus by the electrode socket 16 in the lighting apparatus. In this case, a distance between the flare top of the discharge lamp 2 and the electrode socket 16 is assumed to be A.

On the flare 12 between the first and second stems 13 and 14 of the discharge lamp 2, a metallic vapor deposited film 17 (mainly made of tungsten with electric resistance more than several hundred Ω) is formed by the spatter of the filament 15. When the filament 15 is burnt out, the constant-current supplied from the capacitor C1 shown in FIG. 1 flows to the vapor deposited film 17 and consumes the electric power.

The operation of such the embodiment of the present invention will be described in the following.

When the filament 15 maintains the normal operation, the preheating current from the capacitor C1 flows through the filament 15. Further, as a value of electric resistance of the filament 15 is small against the metallic vapor deposited film, the current scarcely flows to the vapor deposited film 17 which is produced between the adjoining first and second stems 13 and 14. Accordingly, both of the detected results of the first and second filament voltage detecting circuits 3 and 4 become below the DC voltage V1. As a result, the output voltage V2 of the comparator 5 becomes to low level (L) and the inverter output controlling circuit 7 supplies the control signal a1 to the inverter 1 to carry out the normal operation. Thus, the inverter 1 turns the discharge lamp 2 ON in the normal state.

When the discharge lamp 2 comes to the end of its life and the filament is burnt out, the preheating current from the capacitor C1 flows through the vapor deposited film 17 which has a relatively high resistance. Accordingly, of the detected results of the first and second filament voltage detecting circuits 4 and 5, the voltage at the side where the filament was burnt out becomes above the DC voltage V1. As a result, the output voltage V2 of the comparator 5 becomes high level (H) and the inverter output controlling circuit 7 supplies the control signal a1 to the inverter 1 to stop or lower its output. Thus, the inverter 1 does not supply electric power solely to the discharge lamp 2 or reduces it, thus preventing or suppressing the overheat of the stems 13 and 14 and flare 12 of the discharge lamp 2.

As described above, according to the embodiment of the present invention, the first and second filament voltage detecting circuits 3 and 4 detect voltage applied between the first and second stems 13 and 14 of the discharge lamp 2. The inverter output controlling circuit 7 controls the inverter 1 to stop or lower the output of high frequency voltage when the detected results of the first and second filament voltage detecting circuits 4 and 5 are above the specified value. As a result, the electric power consumed by a metallic vapor deposited film by the spatter when the filament is burnt out can be reduced. Thus, the lamp crack caused by the flares and stems dissolved and contacting the tube wall is prevented even if the tube diameter of a discharge lamp is small. In addition, when a resin made member was used for component parts, it is possible to prevent that this resin member is dissolved or ignited. As a result, it becomes possible to make the tube diameter of the discharge lamp small.

Hereinafter, the setting method of a specified value of the inverter output controlling circuit 7 described above (in case of FIG. 1, DC voltage V1 that is used by the comparator 5) will be described with reference to FIG. 3 through FIG. 5.

Figure 3:
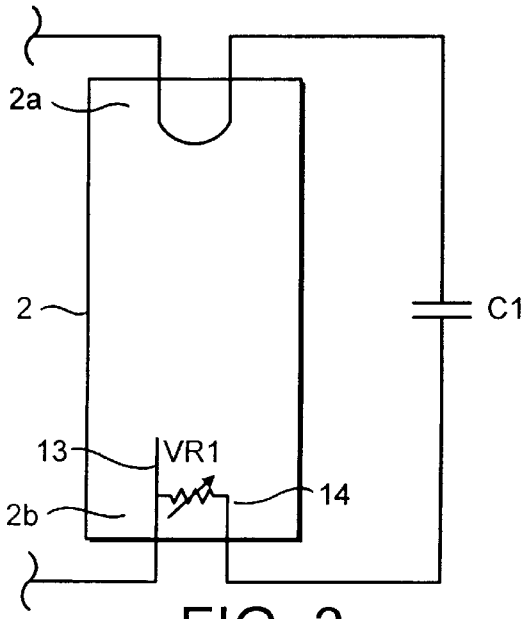
FIG. 3 is a circuit diagram showing the state of the discharge lamp of which filament was burnt out.

FIG. 3 is a circuit diagram showing the state of the discharge lamp 2 shown in FIG. 1, of which filament was burnt out.

In FIG. 3, the filament of the electrode 2*b* at one side of the discharge lamp 2 is burnt out and a resistance value Rf of a metallic vapor deposited film between the first and second stems 13 and 14 of the electrode 2*b* side of the discharge lamp 2 is expressed by a variable resistor VR1. In this case, the capacity of the capacitor C1 which is connected to the discharge lamp 2 in parallel is 10,000 pF.

Figure 4:
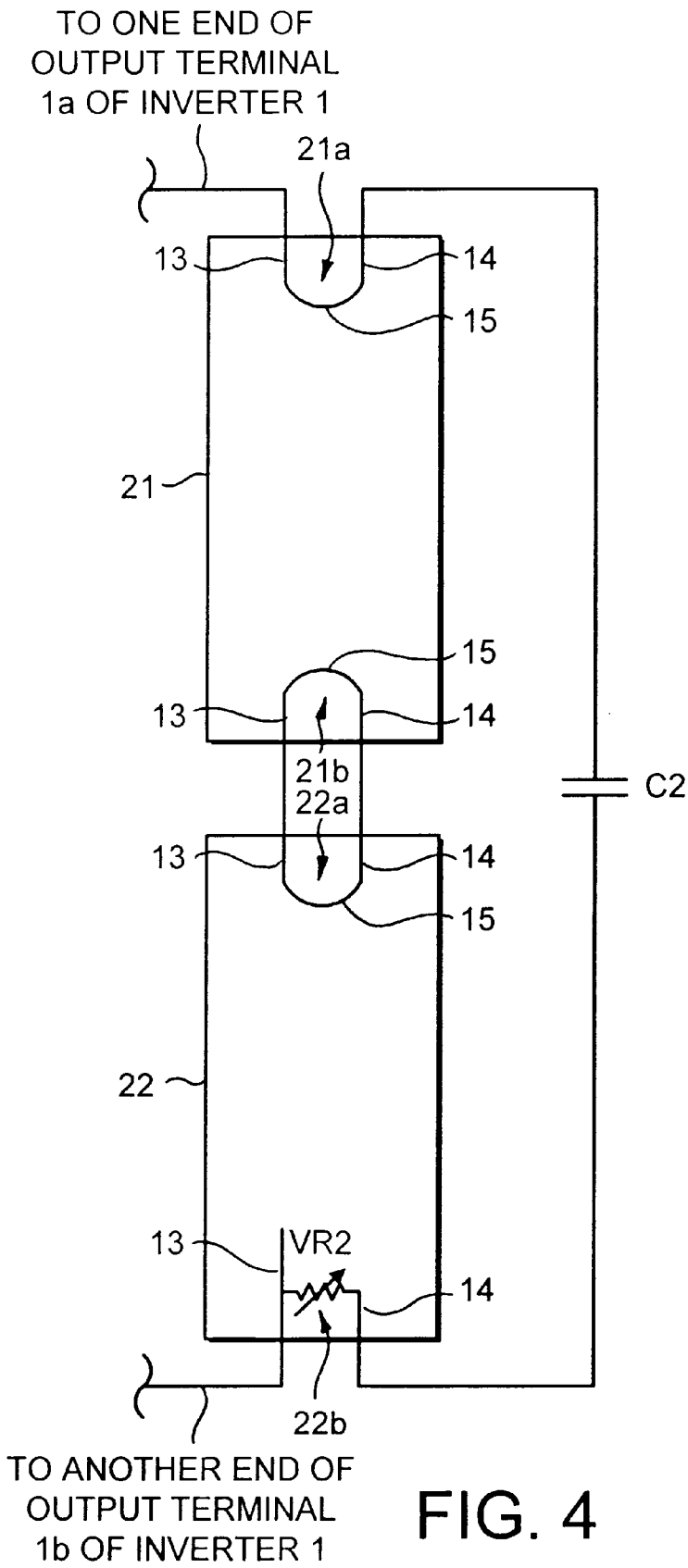
FIG. 4 is a circuit diagram showing two discharge lamps connected in series to an inverter transformer shown in FIG. 1.

FIG. 4 is a circuit diagram showing the state of a discharge lamp 22 which was burnt out when two discharge lamps 21 and 22 are connected in series between the output terminals 1*a* and 1*b* of the inverter 1 shown in FIG. 1.

In FIG. 4, the output terminal 1*a* of the inverter 1 is connected to one end of the filament 15 of an electrode 21*a* of the discharge lamp 21 via the first stem 13 of the electrode 21*a*. The other output terminal 1*b* of the inverter 1 is connected to the first stem 13 of the other electrode 22*b* of the discharge lamp 22.

The first and second stems 13 and 14 of an electrode 21*b* of the discharge lamp 21 are connected to the first and second stems 13 and 14 of the other electrode 22*a* of the discharge lamp 22, respectively.

A capacitor C2 is used for preheating when starting the discharge lamps. This capacitor C2 is connected in parallel to the in-series connected discharge lamps 21 and 22. When described in more detail, one of the terminals of the capacitor C2 is connected to the second stem 14 of the electrode 21*a* of the discharge lamp 21 and the other terminal of the capacitor C2 is connected to the second stem 14 of the electrode 22*b* of the discharge lamp 22.

The filament at the electrode 22*b* side of the discharge lamp 22 was burnt out and a value of resistance Rf of a metallic vapor deposited film between the first and second stems 13 and 14 at the other side is expressed by a variable resistor VR2.

In FIG. 3 and FIG. 4, a distance A between the flare top and the electrode socket 16 of the discharge lamp is 15 mm.

In this case, the capacity of the capacitor C2 is 5,100 pF.

Figure 5:
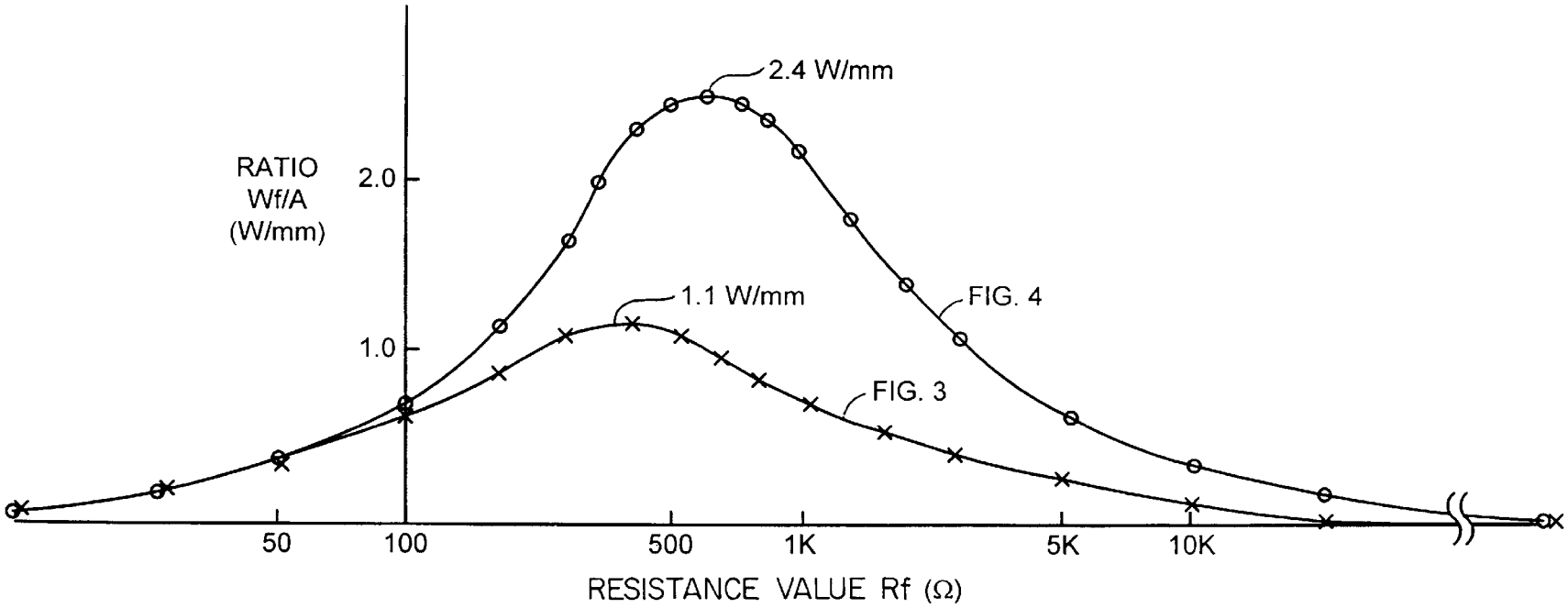
FIG. 5 is a graph showing the relationship between a resistance value Rf and a ratio Wf/A in the state shown in FIG. 3 and FIG. 4.

FIG. 5 is a graph showing the relationship of a resistance value Rf of the metallic vapor deposited film when the inverter 1 applied normal high frequency voltage to the discharge lamps in the state shown in FIG. 3 and FIG. 4 with a ratio Wf/A between the electric power Wf consumed between both ends of the first and second filaments of the discharge lamps and the distance A between the flare top and the electrode socket of the discharge lamps.

As shown in FIG. 5, a ratio Wf/A between the maximum power consumed between both ends of the first and second filaments of the discharge lamps and the distance A between the flare top and the electrode socket of the discharge lamps becomes 1.1 W/mm in the state shown in FIG. 3. A ratio Wf/A between the maximum power consumed between both ends of the first and second filaments of the discharge lamp and the distance A between the flare top and the electrode socket of the discharge lamps becomes 2.4 W/mm in the state shown in FIG. 4. When a resin member is used for the electrode socket 16 of the discharge lamp under this state, heat causing an abnormality of the electrode socket of the discharge lamp is generated. Because of this, a specified value of the inverter output controlling circuit 7 is set up so that a ratio between the maximum power consumed between both ends of the first and second filaments of the discharge lamps and the distance A between the top of the flare 12 and the electrode 16 of the discharge lamp becomes less than 2.4 W/mm in the embodiment of the invention shown in FIG. 1. Thus, the distance A between the top of the flare 12 and the electrode socket 16 of the discharge lamp can be reduced to 15 mm.

Similarly, when a metallic member is used for the electrode socket 16 of the discharge lamp, a specified value of the inverter output controlling circuit 7 is set up so that a ratio Wf/A becomes 4.8 W/mm. Thus, the distance A between the top of the flare 12 and the electrode socket 16 of the discharge lamp can be reduced to 15 mm.

Figure 6:
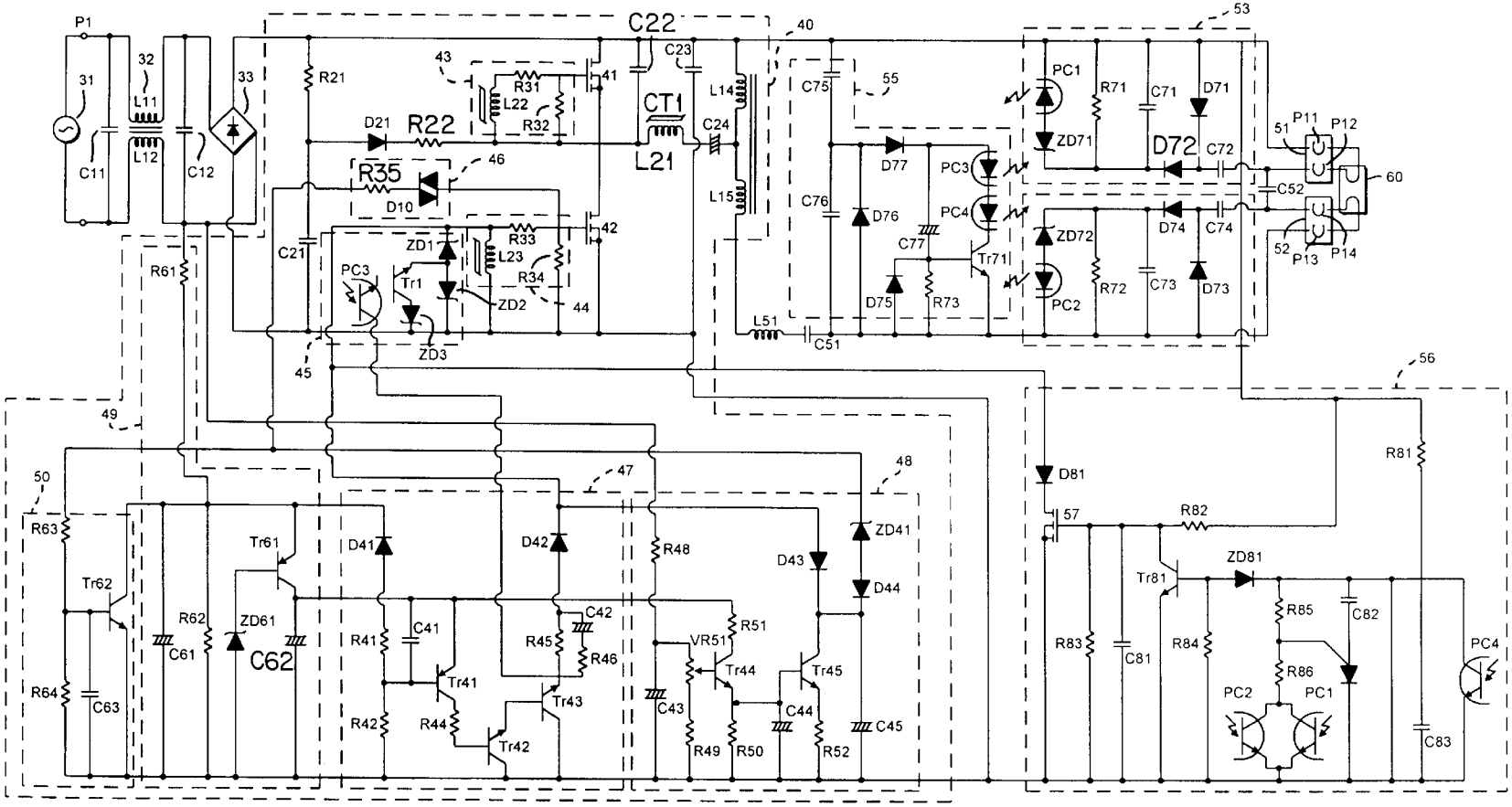
FIG. 6 is a circuit diagram showing a definite example of the discharge lamp lighting apparatus shown in FIG. 1.

FIG. 6 is a circuit diagram showing a definite example of the discharge lamp lighting apparatus shown in FIG. 1.

In FIG. 6, one of the output terminals of a commercial AC power source 31 is connected to an input terminal P1 of the discharge lamp lighting apparatus and the other terminal is connected to an input terminal P2 of the discharge lamp lighting apparatus.

The input terminal P1 is connected to one end of a capacitor C11 and one end of a primary winding L11 of a transformer 32 and the input terminal P2 is connected to one end of the capacitor C11 for removing high frequency and one end of a secondary winding L12 of the transformer 32. As a result of such connections, ripple of AC supply voltage from the commercial AC power source is removed by the capacitor C11 and the transformer 32 and AC supply voltage is led between the other end of the primary winding L11 and that of the secondary winding L12. The other end of the primary winding L11 of the transformer 32 is connected to one of the input terminals of a rectifier circuit 33. The other end of the secondary winding L12 of the transformer 32 is connected to the other input terminal of the rectifier circuit 33. Between the input terminals of the rectifier circuit 33, a capacitor C12 is connected.

AC supply voltage generated between the other end of the primary winding L11 and that of the secondary winding L12 is rectified by the rectifier circuit 33 and converted to non-smoothed DC supply voltage.

The positive pole side output terminal of the rectifier circuit 33 is connected to the positive pole side input terminal of an inverter 40. The negative pole side output terminal of the rectifier circuit 33 is connected to the negative pole side input terminal of the inverter 40.

The inverter 40 is composed of a first switching means 41, e.g., MOSFET, a second switching means 42, e.g., MOSFET, driver circuits 43 and 44 for driving the first and second switching means 41 and 42, a driver control circuit 45, a start-up circuit 46, power supply variation control circuits 47 and 48 for controlling the power supply variation of the first and second switching means 41 and 42, a preheat time control power supply circuit 49, a reset circuit 50 for resetting this preheat time control power supply circuit 49, a winding L21 of a super saturation current transformer CT1, resistors R21 and R22, a diode D21, capacitors C21, C22 and C23, an electrolytic capacitor C24, and windings L14 and L15 of a high frequency transformer T1.

One of the output terminals of the inverter 40 is connected to a terminal P11 of a socket 51. A terminal P11 of the socket 51 is connected to one end of the filament of one of the electrodes of a discharge lamp 60 via a first stem of the other electrode of the discharge lamp 60. The other output terminal of the inverter 40 is connected to a terminal P13 of a socket 52 via an in-series connected inductance L51 and a DC removing capacitor C51. The terminal P13 of the socket 52 is connected to one end of the filament of the other electrode of the discharge lamp 60 via the first stem of the other electrode.

The capacitor 52 is for preheating and resonating when starting up the discharge lamp and is connected to the discharge lamp 60 in parallel. When described in more detail, one of the terminals of the capacitor 52 is connected to a terminal P12 of the socket 51. This terminal P12 of the socket 51 is connected to the other end of the filament of one of the electrodes of the discharge lamp 60 via the second stem of the other electrode. The other end of the capacitor C52 is connected to a terminal P14 of the socket 52. The terminal P14 of the socket 52 is connected to the other end of the filament of the other electrode via the second stem of the other electrode of the discharge lamp 60.

First and second input terminals of a first filament voltage detecting circuit 53 are connected to the terminals P11 and P12 of the socket 51, respectively. The first filament voltage detecting circuit 53 detects voltage applied between both ends of the first and second filaments of one of the electrodes of the discharge lamp 60 and transmits the detected voltage to an output control circuit 56 by a photocoupler PC1.

First and second input terminals of a second filament voltage detecting circuit 54 are connected to the terminals P13 and P14 of the socket 52, respectively. The second filament voltage detecting circuit 54 detects voltage applied between both ends of the first and second filaments of one of the electrodes of the discharge lamp 60 and transmits the detected voltage to the output control circuit 56 by a photocoupler PC2.

First and second input terminals of a lamp voltage detecting circuit 55 are connected to the terminal P11 of the socket 51 and the terminal P13 of the socket 52, respectively. The lamp voltage detecting circuit 55 detects voltage applied between both electrodes of the discharge lamp 60 and transmits this detected voltage to the driver control circuit 45 and the output control circuit 56 by photocouplers PC3 and PC4, respectively.

A driver circuit 43 is composed of a winding L22 of the super saturation current transformer CT1 and resistors R31 and R32.

A driver circuit 44 is composed of a winding L23 of the super saturation current transformer CT1 and resistors R33 and R34.

The driver control circuit 45 is composed of Zener diodes ZD1, ZD2 and ZD3, a phototransistor of the photocoupler PC3 and a transistor Tr1.

The start-up circuit 46 is composed of a trigger diode D10 and a resistor R35.

The power supply variation control circuit 47 is composed of resistors, R41, R42, R43, R44, R45 and R46, diodes D41 and D42, a capacitor C41, an electrolytic capacitor C42, and transistors Tr41, Tr42 and Tr43.

The power supply variation control circuit 48 is composed of resistors R48, R49, R50, R51 and R52, diodes D43 and D44, electrolytic capacitors C43, C44 and C45, transistors Tr44 and Tr45 and Zener diode ZD41.

The preheat time control power supply circuit 49 is composed of resistors R61 and R62, capacitors C61 and C62, transistor Tr61 and Zener diode ZD61.

The reset circuit 50 is composed of resistors R63 and R64, a capacitor C63 and a transistor Tr62

The first filament voltage detecting circuit 53 is composed of a resistor R71, capacitors C71 and C72, diodes D71 and D72, a Zener diode ZD71 and a light emitting diode of the photocoupler PC1.

The second filament voltage detecting circuit 54 is composed of a resistor R72, capacitors C73 and C74, diodes D73 and D74, a Zener diode ZD72 and a light emitting diode of the photocoupler PC2.

The lamp voltage detecting circuit 55 is composed of a resistor R73, a capacitor C76, an electrolytic capacitor C77, diodes D75, D76 and D77, light emitting diodes of the photocouplers PC3 and PC4, and a transistor Tr71.

The output control circuit 56 is composed of resistors R81, R82, R83, R84, R85 and R86, capacitors C81 and C82, an electrolytic capacitor C83, a diode D81, a Zener diode ZD81, phototransistors of photocouplers PC1, PC2 and PC4, a transistor Tr81, a MOSFET 57 and a thyristor SCR1.

A definite example of the operation of the discharge lamp lighting apparatus in the construction as shown above will be described in the following.

When the discharge lamp 60 is in the normal state, the photodiodes of the photocouplers PC1 and PC2 of the first and second filament voltage detecting circuits 53 and 54 are in the OFF state. As a result, in the output control circuit 56, the phototransistors of the photocouplers PC1 and PC2 are in the OFF state and the transistor Tr81 is in the ON state and the MOSFET 57 is in the OFF state. Therefore, as no current flows to the output control circuit 56 from the connecting point of the resistor R33 of the driver circuit 44 and the winding L23 of the super saturation current transformer CT1, the switching means 41 and 42 maintain the normal oscillation and the discharge lamp 60 maintains the normal lighting state.

When the filament of at least one of both electrodes of the discharge lamp 60 is burnt out, at least one of the photodiodes of the photocouplers PC1 and PC2 of the first and second filament voltage detecting circuits 53 and 54 is turned ON. As a result, in the output control circuit 56, at least one of the phototransistors of the photocouplers PC1 and PC2 is turned ON, the transistor Tr81 is turned OFF and the MOSFET 57 is turned ON. Therefore, the current flows to the output control circuit 56 from the connecting point of the resistor R33 of the driver circuit 44 and the winding L23 of the super saturation current transformer CT1, the switching means 41 and 42 stop the oscillation and the discharge lamp 60 is put out.

As shown in such the definite example, the embodiment of the present invention shown in FIG. 1 can be realized.

Hereinafter, a case where an impedance element is mounted between both ends of the first and second filaments in parallel in the embodiment shown in FIG. 1 through FIG. 5 will be described.

Figure 7:
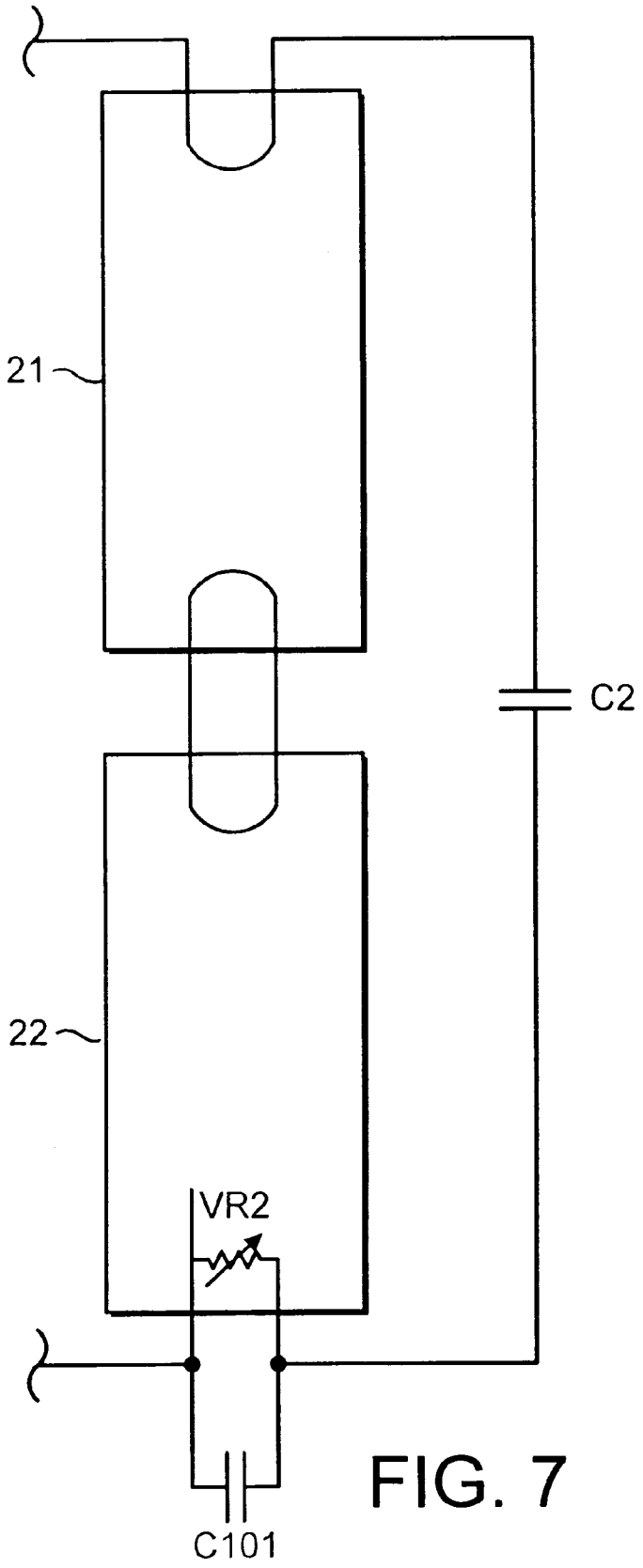
FIG. 7 is a circuit diagram showing the state of a capacitor mounted between adjoining stems of electrodes of the discharge lamp shown in FIG. 3.

FIG. 7 is a circuit diagram showing the state where a capacitor is mounted between both ends of the first and second filaments of one of the electrodes of the discharge lamp shown in FIG. 4.

In FIG. 7, a capacitor C101 is connected to a variable resistor VR2 in parallel.

A distance A between the flare top and the electrode socket of a discharge lamp 22 is 15 mm. Further, the capacity of the capacitor C2 is 5,100 pF.

Figure 8:
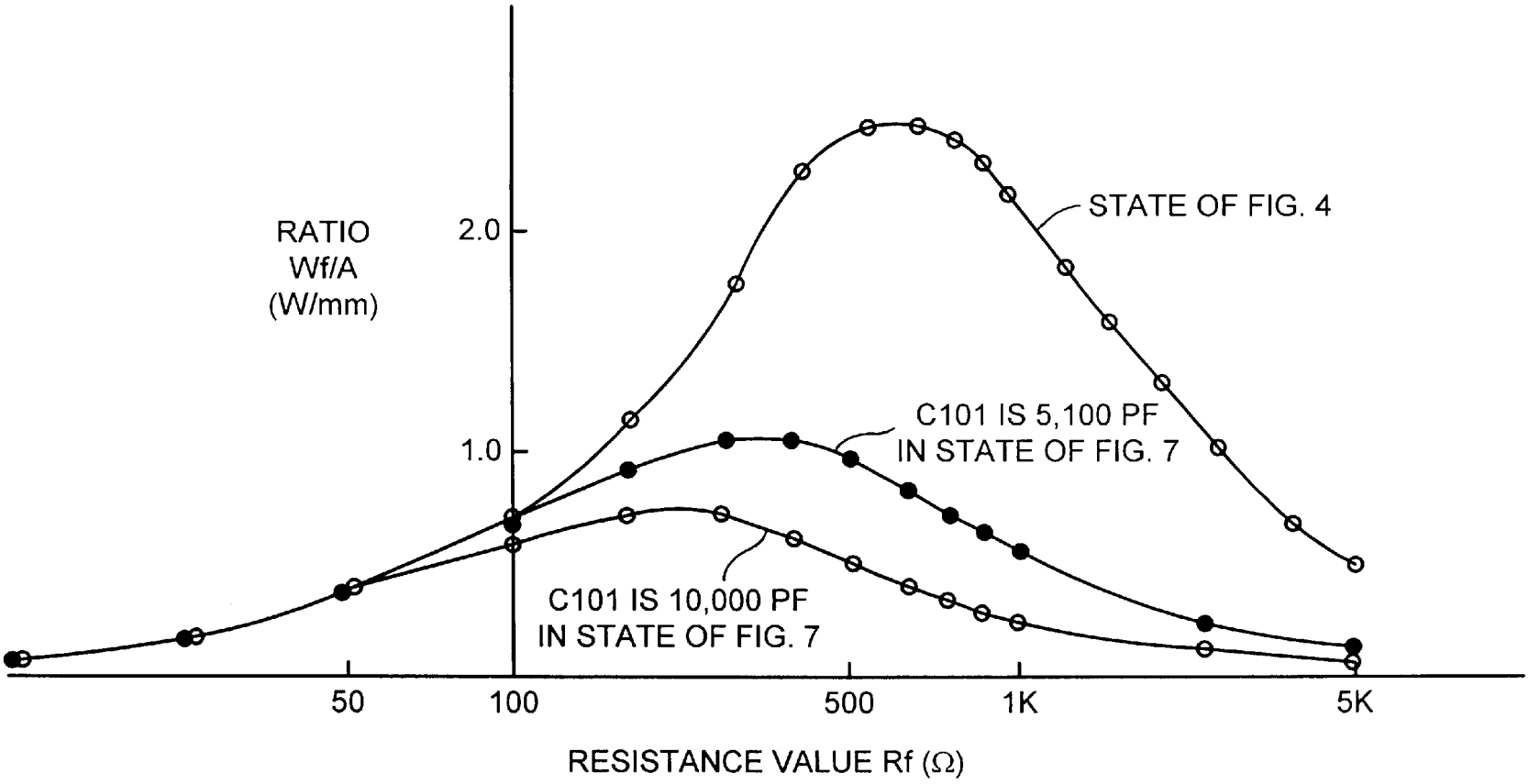
FIG. 8 is a graph showing the relationship between a resistance value Rf and a ratio Wf/A in the state shown in FIG. 7.

FIG. 8 is a graph showing the relationship between a resistance value Rf of the metallic vapor deposited film when the inverter applied ordinary high frequency voltage to the discharge lamp in the state shown in FIG. 7 and a ratio Wf/A of the electric power Wf consumed between both ends of the first and second filaments of the discharge lamp with a distance between the flare top and the electrode socket of the discharge lamp.

As shown in FIG. 8, in the state shown in FIG. 4, that is, the state without the capacitor C101 provided, a ratio Wf/A of the maximum power consumed between both ends of the filaments of the discharge lamp and a distance A between the flare top and the electrode socket of the discharge lamp was 2.4 W/mm.

On the other hand, when the capacity of the capacitor C101 is 5,100 pF in the state shown in FIG. 7, a ratio Wf/A at the maximum power consumption becomes 1.1 W/mm. Further, when the capacity of the capacitor C101 is 10,000 pF, a ratio Wf/A at the maximum power consumption becomes 0.7 W/mm.

As shown in FIG. 8, when a capacitor is mounted between both ends of the first and second filaments of the discharge lamp, it becomes possible to further reduce electric power generated on the metallic vapor deposited film by the spatter when the filament is burnt out. Accordingly, it becomes possible to make the tube diameter of the discharge lamp more small.

Figure 9:
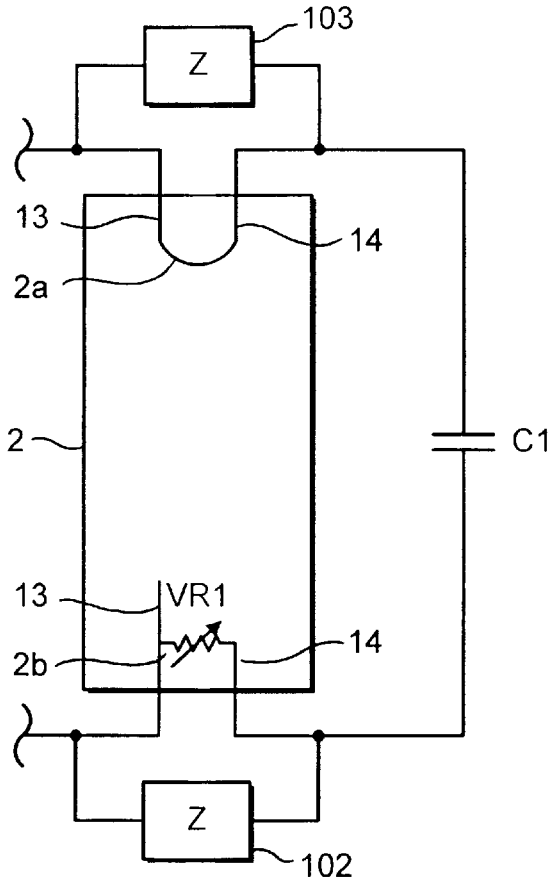
FIG. 9 is a circuit diagram showing the state of impedance elements such as capacitors, etc. mounted between the adjoining stems of the discharge lamp shown in FIG. 3.

FIG. 9 is a circuit diagram showing the state of an impedance element such as a capacitor, etc. mounted between both ends of the adjoining first and second filaments of the electrode at the side to which preheating current flows via the capacitor C1 in the discharge lamp shown in FIG. 3.

In FIG. 9, impedance elements 102 and 103 are connected between the first and second stems 13 and 14 of the electrodes 2*a* and 2*b* of the discharge lamp 2, respectively.

When assuming that frequency of high frequency voltage supplied to the discharge lamp 2 is f, impedance of the impedance element 102 is Z, the capacity of the capacitor C1 is Cf, voltage (lamp voltage) applied between the electrodes 2*a* and 2*b* of the discharge lamp 2 is VL and resistance (resistance of the metallic vapor deposited film) of the variable resistor VR1 is Rf, the electric power W1 that is consumed on the metallic vapor deposited film in the state shown in FIG. 9 can be expressed by the following equation (1).

$$W1 = \left(\frac{2\pi f \times Cf \times VL \times Z}{Rf \times Z}\right)^2 Rf \quad (1)$$

The electric power W2 that is consumed on the metallic vapor deposited film in the state shown in FIG. 4 can be expressed by the following equation (2)

$$W2=(2\pi f\times Cf\times VL)^2\times Rf \ldots \quad (2)$$

As W1 is surely less than W2 (W1<W2) from Equations (1) and (2), when the impedance elements 102 and 103 are provided, it is possible to confirm that power consumed on the metallic vapor deposited film can be further reduced. Further, capacitor, coil, transformer, diode and combinations thereof are applicable for the impedance elements 102 and 103.

Figure 10:
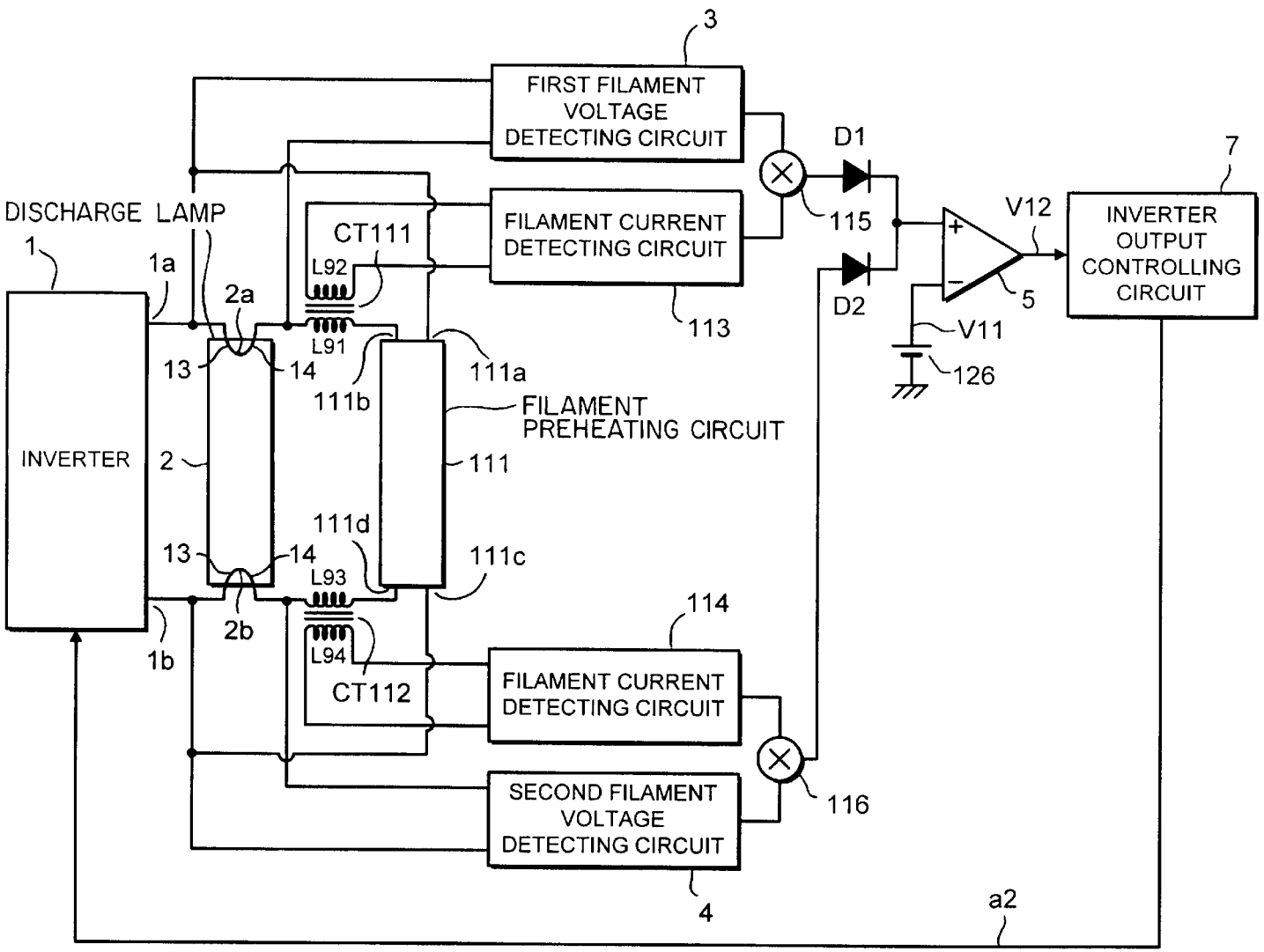
FIG. 10 is a block diagram showing a second embodiment of the discharge lamp lighting apparatus of the present invention.

FIG. 10 is a block diagram showing a second embodiment of the discharge lamp lighting apparatus of the present invention and the same reference numerals as those shown in FIG. 1 are assigned to the same component elements and the explanation thereof is omitted.

A filament preheating circuit 111 is corresponding to the capacitor C1 shown in FIG. 1, a first terminal 111*a* is connected to the first stem 13 of the electrode 2*a* of the discharge lamp 2 and a second terminal 111*b* is connected to the second stem 14 of the electrode 2*a* of the discharge lamp 2 via a primary winding L91 of a current transformer CT111. A third terminal 111*c* of the filament preheating circuit 111 is connected to the first stem 13 of the electrode 2*b* of the discharge lamp 2 and a fourth terminal 111*d* is connected to the second stem 14 of the electrode 2*b* of the discharge lamp 2 via a primary winding L93 of a current transformer CT112.

One end and the other end of a secondary winding L92 of the current transformer CT111 are connected to a filament current detecting circuit 113. The filament current detecting circuit 113 detects the current flowing to the filament of the electrode 2*a* of the discharge lamp 2 by detecting the voltage of the secondary winding L92 and converting the detected current into voltage, supplies it to one of the input terminals of a multiplier 115. The detected voltage from the first filament voltage detecting circuit 3 is led to the other input terminal of the multiplier 115.

The multiplier 115 multiplies the detected result of the first filament voltage detecting circuit 3 by the detected result of the filament current detecting circuit 113 and supplies the result of this computation, that is, the voltage to the non-inversion input terminal (+) of the comparator 5 via the anode-cathode path of the diode D1.

One end and the other end of a secondary winding L94 of the current transformer CT112 are connected to a filament current detecting circuit 114. The filament current detecting circuit 114 detects the current flowing to the electrode 2*b* of the discharge lamp 2 by detecting the voltage of the secondary winding L94 and converting the detected current into voltage, supplies it to one of the input terminals of a multiplier 116. The detected voltage from the second filament voltage detecting circuit 4 is led to the other input terminal of the multiplier 116.

The multiplier 116 multiplies the detected result of the filament voltage detecting circuit 4 by the detected result of the filament current detecting circuit 114 and supplies the result of this computation, that is, the voltage to the non-inversion input terminal (+) of the comparator 5 via the anode-cathode path of the diode D2.

DC voltage V11 from a DC regulated voltage source 126 is led to the inversion input terminal (−) of the comparator 5.

When at least one of the results of computation by the multipliers 115 and 116 exceeds the DC voltage V11, the comparator 5 supplies a high level (H) output voltage V2 to the inverter output controlling circuit 7. Otherwise, the comparator 5 supplies a low level (L) output voltage V2 to the inverter output controlling circuit 7.

As a result, the multiplier 115, the filament voltage detecting circuit 3 and the filament current detecting circuit 113 comprise a filament power detecting circuit to detect electric power consumed by the electrode 2*a* of the discharge lamp 2. The multiplier 116, the filament voltage detecting circuit 4 and the filament current detecting circuit 114 comprise a filament power detecting circuit to detect electric power consumed by the electrode 2*b* of the discharge lamp 2. The diodes D1 and D2, the comparator 5, the DC regulated voltage source 126 and the inverter output controlling circuit 7 comprise an output control circuit to stop or lower the output of high frequency voltage by controlling the inverter 1 when the results of computation of these filament power detecting circuits exceed a specified value.

As described above, according to the second embodiment of the present invention, it is possible to obtain the same effect as that in the first embodiment of the present invention and properly control the output of high frequency voltage by accurately detecting electric power consumed by the metallic vapor deposited film and operates accordingly.

Figure 11:
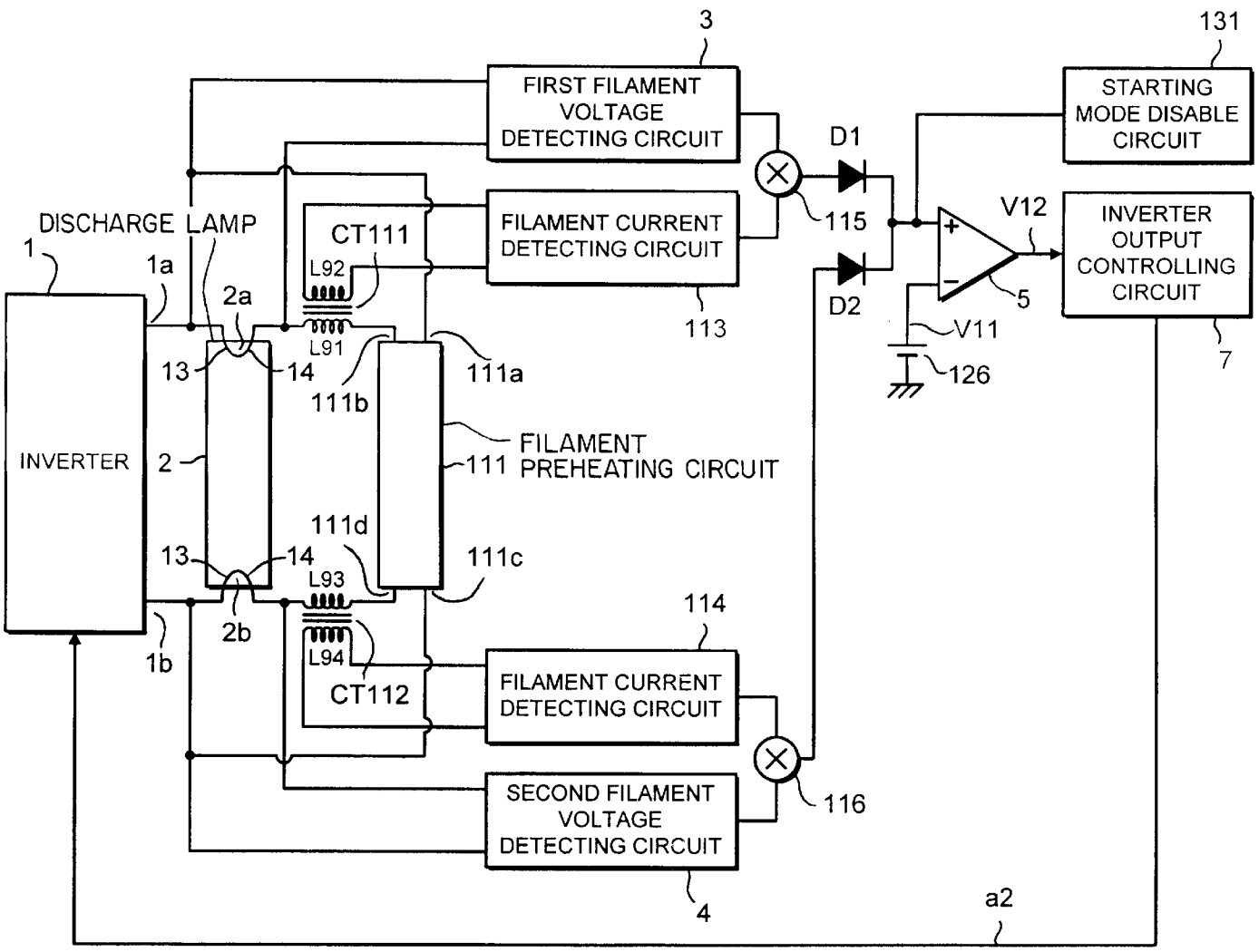
FIG. 11 is a block diagram showing a third embodiment of the discharge lamp lighting apparatus of the present invention.

FIG. 11 is a block diagram showing a third embodiment of the discharge lamp lighting apparatus of the present invention, and the same reference numerals shown in FIG. 10 are assigned to the same component elements as those in FIG. 10 and the explanation thereof is omitted.

In the third embodiment of the present invention, a starting mode disable circuit 131 is provided to disable the inverter output controlling circuit 7 in the starting mode.

The starting mode disable circuit 131 sets the non-inversion input terminal (+) of the comparator 5 at the low level by force in the starting mode.

According to the third embodiment of this invention, it is possible to prevent the output of high frequency voltage from being stopped or lowered by erroneously controlling the inverter 1 in the starting mode.

Further, in the embodiments shown in FIG. 1 through FIG. 11, when the inverter output controlling circuit 7 stopped or lowered the output of high frequency voltage by controlling the inverter 1, if the circuit is constructed so as to latch this state, it is possible to prevent the output of the inverter 1 to rise again in the state where the filament of the discharge lamp is burnt out and save the power. Further, in the embodiments shown in FIG. 1 through FIG. 11, the capacitor for preheating the filament is provided outside the inverter but a preheating capacitor may be provided in the inverter.

Figure 12:
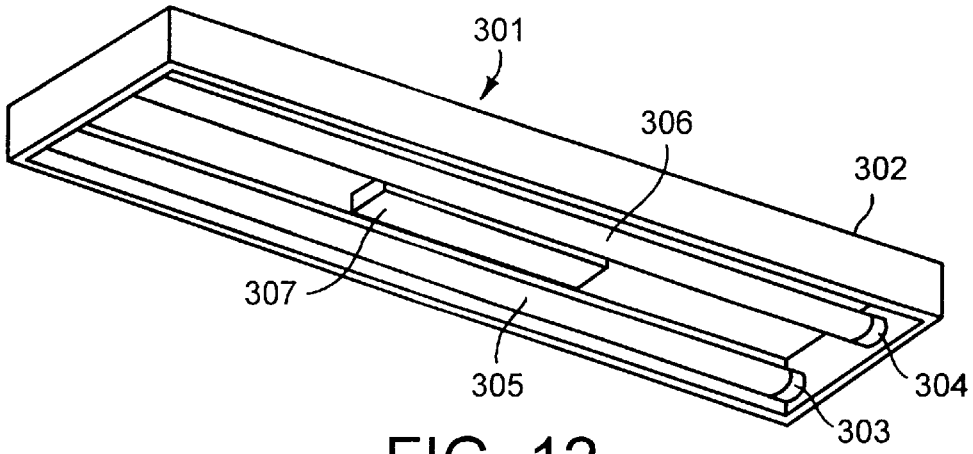
FIG. 12 is a perspective view showing a lighting apparatus applied with the discharge lamp lighting apparatus in the embodiments of the present invention shown in FIG. 1 through FIG. 11.

FIG. 12 is a perspective view showing a lighting apparatus applied with the discharge lamp lighting apparatus of the embodiment shown in FIG. 1 through FIG. 11.

In FIG. 12, a lighting apparatus 301 mounts discharge lamps 305 and 306 in sockets 303 and 304 of the main body of the lighting apparatus and houses the discharge lamp lighting apparatus 307 in the inside. The discharge lamps 305 and 306 are lighted by the discharge lamp lighting apparatus 307.

The embodiments of the present invention shown in FIG. 1 through FIG. 11 in the construction as described above can be applied to a lighting apparatus.

According to the present invention, it is possible to reduce electric power generated on the metallic vapor deposited film by the spatter when the filament is burnt out. As a result, even when the tube diameter of a discharge lamp is small, the lamp crack caused when the flares and stems are dissolved and contact the tube wall is prevented. Further, when resin made component parts are used, it is possible to prevent melting and ignition of this resin made parts and it becomes possible to make the tube diameter of the discharge lamp small.

What is claimed is:

1. A discharge lamp lighting apparatus comprising:

an inverter for converting input DC voltage into high frequency and supplying the converted high frequency voltage to the discharge lamp having filaments;

preheating means for preheating the filaments of the discharge lamp;

filament voltage detecting circuits for detecting voltage applied between both ends of the filaments of the discharge lamp; and an output control circuit for controlling the inverter to stop or lower the output of high frequency voltage when the detected results of the filament voltage detecting circuits exceed a specified value.

2. The discharge lamp lighting apparatus claimed in claim 1, wherein the preheating means includes a capacitor connected to the discharge lamp in parallel.

3. The discharge lamp lighting apparatus claimed in claim 1, wherein the discharge lamp includes an arc tube having both ends and flares provided at both ends of the arc tube for mounting the filaments, and the discharge lamp lighting apparatus has further electrode sockets formed with resin to which both ends of the arc tube are mounted, and the output control circuit sets a specified value so that a ratio between the maximum electric power consumed by the filaments when the discharge lamp is lighted and a distance between the flare top and the electrode socket becomes less than 2.4 W/mm.

4. The discharge lamp lighting apparatus claimed in claim 1, wherein the discharge lamp includes an arc tube having both ends and flares provided at both ends of the arc tube for mounting the filaments, and the discharge lamp lighting apparatus has further electrode sockets formed with metal to which both ends of the arc tube are mounted, and the output control circuit sets a specified value so that a ratio between the maximum electric power consumed by the filaments when the discharge lamp is lighted and a distance between the flare top and the electrode socket becomes less than 4.8 W/mm.

5. The discharge lamp lighting apparatus claimed in claim 1, further comprising:

an impedance element connected to the filament of the discharge lamp in parallel.

6. The discharge lamp lighting apparatus claimed in claim 5, wherein the impedance element includes a capacitor.

7. The discharge lamp lighting apparatus claimed in claim 1, further comprising:

a circuit for disabling the output control circuit in the starting mode.

8. The discharge lamp lighting apparatus claimed in claim 1, further comprising:

means for latching a state wherein the output control circuit controls the inverter to stop or lower the output of high frequency voltage.

9. A discharge lamp lighting apparatus comprising:

an inverter for converting input DC voltage into high frequency voltage and supplying the converted high frequency voltage to the discharge lamp having filaments;

preheating means for preheating the filaments of the discharge lamp;

filament voltage detecting circuits for detecting voltage applied between both ends of the filaments of the discharge lamp;

filament current detecting circuits for detecting current flowing to the filaments of the discharge lamp;

multipliers for multiplying the detected result of the filament voltage detecting circuit by the detected result of the filament current detecting circuit; and an output control circuit for controlling the inverter to, stop or lower the output of high frequency voltage when the results of computation by the multipliers exceed a specified value.

10. The discharge lamp lighting apparatus claimed in claim 9, wherein the preheating means includes a capacitor connected to the discharge lamp in parallel.

11. The discharge lamp lighting apparatus claimed in claim 9, wherein the discharge lamp includes an arc tube having both ends and flares provided at both ends of the arc tube for mounting the filaments, and the discharge lamp lighting apparatus has further electrode sockets formed with resin to which both ends of the arc tube are mounted, and the output control circuit sets a specified value so that a ratio between the maximum electric power consumed by the filaments when the discharge lamp is lighted and a distance between the flare top and the electrode socket becomes less than 2.4 W/mm.

12. The discharge lamp lighting apparatus claimed in claim 9, wherein the discharge lamp includes an arc tube having both ends and flares provided at both ends of the arc tube for mounting the filaments, and the discharge lamp lighting apparatus has further electrode sockets formed with metal to which both ends of the arc tube are mounted, and the output control circuit sets a specified value so that a ratio between the maximum electric power consumed by the filaments when the discharge lamp is lighted and a distance between the flare top and the electrode socket becomes less than 4.8 W/mm.

13. The discharge lamp lighting apparatus claimed in claim 9, further comprising:

an impedance element connected to the filament of the discharge lamp in parallel.

14. The discharge lamp lighting apparatus claimed in claim 13, wherein the impedance element includes a capacitor.

15. The discharge lamp lighting apparatus claimed in claim 9, further comprising:

a circuit for disabling the output control circuit in the starting mode.

16. The discharge lamp lighting apparatus claimed in claim 9, further comprising:

means for latching the state wherein the output control circuit controls the inverter so as to stop or lower the output of high frequency voltage.

17. A discharge lamp lighting apparatus comprising:

an inverter for converting input DC voltage into high frequency voltage and supplying the converted high frequency voltage to the discharge lamp having filaments;

preheating means for preheating the filaments of the discharge lamp;

filament electric power detecting circuits for detecting electric power consumed by the filaments of the discharge lamp; and an output control circuit for controlling the inverter to stop or lower the output of high frequency voltage when the detected result of the filament power detecting circuit exceeds a specified value.

18. The discharge lamp lighting apparatus claimed in claim 17, wherein the preheating means includes a capacitor connected to the discharge lamps in parallel.

19. The discharge lamp lighting apparatus claimed in claim 17, wherein the discharge lamp includes an arc tube having both ends and flares provided at both ends of the arc tube for mounting the filaments, and the discharge lamp lighting apparatus has further electrode sockets formed with resin to which both ends of the arc tube are mounted, and the output control circuit sets a specified value so that a ratio between the maximum electric power consumed by the filaments when the discharge lamp is lighted and a distance between the flare top and the electrode socket becomes less than 2.4 W/mm.

20. The discharge lamp lighting apparatus claimed in claim 17, wherein the discharge lamp includes an arc tube having both ends and flares provided at both ends of the arc tube for mounting the filaments, and the discharge lamp lighting apparatus has further electrode sockets formed with metal to which both ends of the arc tube are mounted, and the output control circuit sets a specified value so that a ratio between the maximum electric power consumed by the filaments when the discharge lamp is lighted and a distance between the flare top and the electrode socket becomes less than 4.8 W/mm.

21. The discharge lamp lighting apparatus claimed in claim 17, further comprising:

an impedance element connected to the filaments of the discharge lamp in parallel.

22. The discharge lamp lighting apparatus claimed in claim 21, wherein the impedance element includes a capacitor.

23. The discharge lamp lighting apparatus claimed in claim 17, further comprising:

a circuit for disabling the output control circuit in the starting mode.

24. The discharge lamp lighting apparatus claimed in claim 17, further comprising:

means for latching the state wherein the output control circuit controls the inverter so as to stop or lower the output of high frequency voltage.

25. A discharge lamp lighting apparatus comprising:

an inverter for converting input DC voltage into high frequency voltage and supplying the converted high frequency to a discharge lamp which includes an arc tube having both ends, flares provided at both ends and filaments mounted to the flares;

preheating means for preheating the filaments of the discharge lamp;

filament voltage detecting circuits for detecting voltage applied between both ends of the filaments of the discharge lamp; and an output control circuit for controlling the inverter to stop or lower the output of high frequency voltage when the detected result of the filament voltage detecting circuit exceeds a specified value, and the specified value of the output control circuit is set so that a ratio between the maximum electric power consumed by the filaments of the discharge lamps when the discharge lamp is lighted and a distance between the flare top and electrode socket becomes less than 2.4 W/mm when resin is used for the electrode sockets to where the arc tube is mounted.

26. A discharge lamp lighting apparatus comprising:

an inverter for converting input DC voltage into high frequency voltage and supplying the converted high frequency to the discharge lamps which include an arc tube having both ends, flares provided at both ends and filaments mounted to the flares;

preheating means for preheating the filaments of the discharge lamp;

filament voltage detecting circuits for detecting voltage applied between both ends of the filaments of the discharge lamp; and an output control circuit for controlling the inverter so as to stop or lower the output of high frequency voltage when the detected result of the filament voltage detecting circuit exceeds a specified value, and the specified value of the output control circuit is set so that a ratio between the maximum electric power consumed by the filaments of the discharge lamps when the discharge lamp is lighted and a distance between the flare top and electrode socket becomes less than 4.8 W/mm when metal is used for the electrode sockets to where the arc tube is mounted.

27. A lighting apparatus comprising the discharge lamp lighting apparatus claimed in one of claims 1, 9, 17, 25 and 26; and a main body to house the discharge lamp lighting apparatus.

* * * * *